United States Patent [19]

Nagazumi

[11] Patent Number: 4,581,610

[45] Date of Patent: Apr. 8, 1986

[54] METHOD AND APPARATUS FOR LOCALLY INTENSIFYING BRIGHTNESS IN A VIDEO DISPLAY DEVICE

[75] Inventor: Yasuo Nagazumi, Tokyo, Japan

[73] Assignee: General Research of Electronics, Inc., Tokyo, Japan

[21] Appl. No.: 482,887

[22] Filed: Apr. 6, 1983

[51] Int. Cl.[4] ..... G09G 1/00

[52] U.S. Cl. ..... 340/723; 340/733; 340/793; 340/715

[58] Field of Search ..... 340/709, 723, 735, 789, 340/790, 793, 728, 733, 715; 358/107, 168; 128/663, 690, 706

[56] References Cited

U.S. PATENT DOCUMENTS

| | | | |
|---|---|---|---|
| 3,294,084 | 12/1966 | Schuler | 128/712 |
| 4,094,310 | 6/1978 | McEachern | 128/419 D |
| 4,495,491 | 1/1985 | Postl | 340/709 |
| 4,495,642 | 1/1985 | Zellmer | 382/1 |

*Primary Examiner*—Marshall M. Curtis

*Attorney, Agent, or Firm*—Trexler, Bushnell & Wolters, Ltd.

[57] ABSTRACT

A method for intensifying brightness of a predetermined pattern in a video display comprises detecting the duration of predetermined portions of said video signal; detecting the predetermined pattern in these predetermined portions of said video signal; and producing an output control signal in response to each detection of the predetermined pattern of at least a predetermined duration. Apparatus is provided for carrying out the method.

10 Claims, 3 Drawing Figures

METHOD AND APPARATUS FOR LOCALLY INTENSIFYING BRIGHTNESS IN A VIDEO DISPLAY DEVICE

BACKGROUND OF THE INVENTION

This invention relates to display devices and in particular to localized control of brightness level in a video display apparatus of the type utilized with a computer or the like.

A video display device such as a cathode ray tube (CRT) is frequently utilized as a display in conjunction with data processing apparatus such as computers, word processing systems or the like. Heretofore, such systems have usually produced a display of uniform brightness upon the associated video display apparatus. For example, alphanumeric characters are generally displayed as a collection or pattern of illuminated points or pixels on the video screen. However, the brightness of all of these points or pixels making up these alphanumeric characters has heretofore been uniform.

While the overall brightness level of such displays may often be controlled by the operator, many systems have not made any provision for emphasizing given characters or patterns. In many applications, the operator may wish to verify or identify certain information which may be contained in the display, without the necessity of visually inspecting the entire display. Hence, some method and apparatus for emphasizing or highlighting the desired information might prove particularly useful in such applications.

OBJECTS AND SUMMARY OF THE INVENTION

Accordingly, it is a general object of this invention to provide a novel and improved method and apparatus for locally intensifying brightness in a video display device.

In accordance with one aspect of the invention, there is provided a method for intensifying brightness of a predetermined pattern in a video display comprising detecting the duration of predetermined portions of said video signal; detecting said predetermined pattern in said predetermined portions of said video signal; and producing an output control signal in response to each detection of said predetermined pattern of at least a predetermined duration.

In accordance with another aspect of the invention, there is provided apparatus for intensifying brightness of a predetermined pattern in a video display comprising duration detecting means for detecting the duration of predetermined portions of said video signal and producing a corresponding duration signal; pattern detecting means for detecting a predetermined pattern of said predetermined portions of said video signal and for producing a corresponding pattern detection signal; and control means for producing an output control signal in response to presence of both said duration signal and said pattern detection signal.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in connection with the accompanying drawings in the several figures of which like reference numerals identify like elements, and in which:

DETAILED DESCRIPTION OF THE ILLUSTRATED EMBODIMENT

Figure 1:
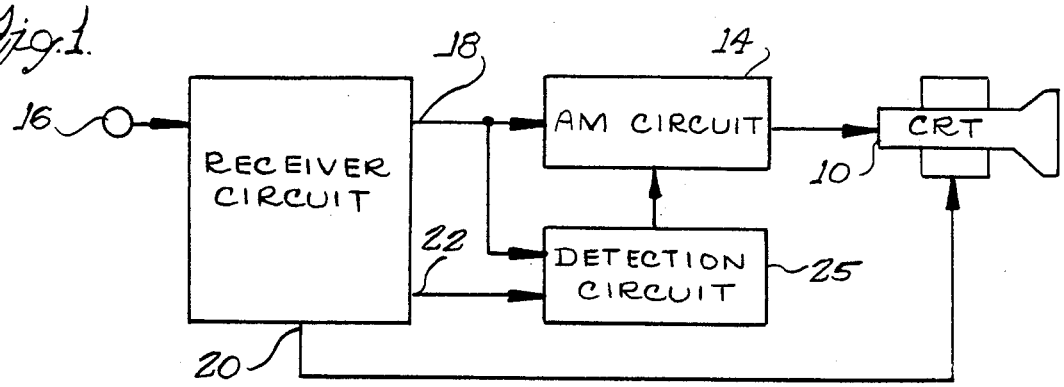
FIG. 1 is a block schematic diagram illustrating a video display system in conjunction with which the present invention may advantageously be utilized.

Referring now to the drawings and initially to FIG. 1, a video display device such as a Brown tube or cathode ray tube (CRT) 10 is diagramatically illustrated. The CRT 10 displays a video image in accordance with suitable control signals generated by a receiver circuit 12 and an amplitude modulation (AM) circuit 14 in response to video signals received at an input terminal 16. In this regard, the incoming video signal at terminal 16 includes information as to the desired content of the video display as well as suitable horizontal and vertical scanning control or synchronizing ("sync") signals for controlling the scanning of the CRT 10. To this end, the video information is produced at an output 18 of the receiver circuit 12. Similarly, the vertical and horizontal sync signals are respectively produced at outputs 20 and 22 of the receiver circuit 12.

Departing from convention, and in accordance with the invention, a novel brightness control circuit 25 feeds a further brightness control signal to the AM circuit 14. This brightness control circuit 25 receives the video signals from output 18 of the receiver as well as the horizontal sync signal from output 22. Advantageously, the brightness control circuit 25 recognizes portions of the received video signal which correspond to preselected patterns or groups of points in the video image. This will hereinafter be referred to as "pattern detection", detection of patterns, or similar terminology.

In response to detection of these patterns the circuit 25 produces suitable control signals to the AM circuit 14 for locally intensifying brightness at those locations upon the screen of the video display device or CRT 10 at which the preselected patterns are produced.

Figure 2:
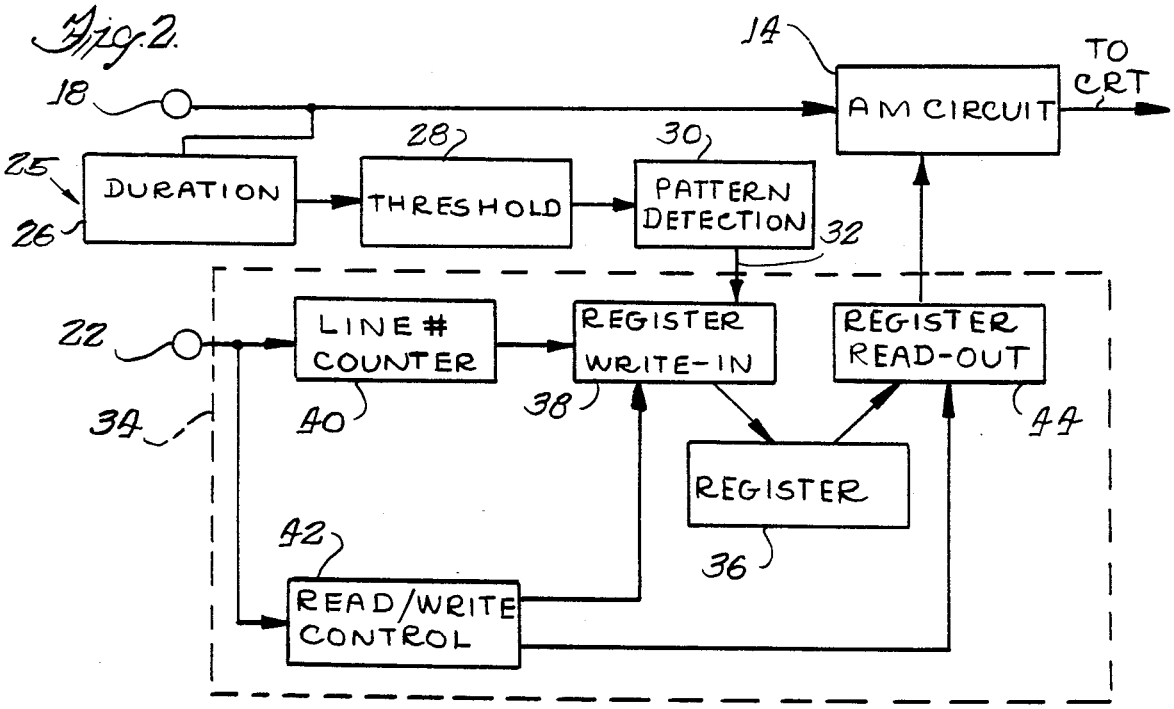
FIG. 2 is a block schematic diagram illustrating further details of one embodiment of apparatus in accordance with the present invention.

Referring now to FIG. 2 wherein one embodiment of the circuit 25 is illustrated in block schematic form. The circuit 25 receives the video signals produced at output 18 of the receiving circuit 12 at duration detection circuits 26, 28. This duration detection avoids response of the system to noise, spurious signals, or the like. As will be seen later, duration detection also aids in assuring the presence of the selected patterns in one or more positions in a repeatedly scanned video image, in accordance with conventional syncronizing techniques.

The first circuit 26, functions to detect the duration of video signals at the terminal 18 and produce a signal of a level corresponding to this duration. The circuit 28 compares the level of this latter signal with a predetermined threshold level and produces an output pulse for each signal which is in excess of a predetermined level and hence in excess of a predetermined duration.

These latter pulse signals are fed to a pattern detection circuit 30. The pattern detection circuit 30 is in turn responsive to signals which in addition to exceeding a predetermined duration (as detected by circuits 26 and 28) also define a predetermined pattern for producing control output signal at an output 32 thereof.

In operation, it will be recognized that the foregoing circuits produce a control output signal which may be utilized by AM circuit 14 to control the brightness or intensity of given portions of the display of CRT 10. Such control is achieved in response to signal information corresponding to one or more preselected patterns in the video signal, if this signal information is of sufficient duration.

In accordance with a preferred form of the invention, additional synchronizing and control circuits 34 are provided for controlling the operation of the AM circuit 14. These additional circuits are responsive to the control signals produced at the output 32 as well as to the horizontal sync signal produced at the output 22 of receiver circuit 12. In this regard, a storage register 36 comprises a plurality of storage locations or bits corresponding to the points or pixels scanned in the CRT 10. A register write-in circuit 38 is coupled to receive the output control signal at output 32 directly, and the sync signal at output 22 by way of a line number counter 40 and a register read/write control circuit 42. Similarly, a register read-out circuit 44 is coupled for reading out the information from the register 36 in response to the register read/write control circuit 42.

In operation, the control signals produced at output 32 correspond to groups or patterns of points in the video display image at which brightness is to be intensified. These signals are synchronized during a write-in period by the line counter circuit 40 so as to be written in to the corresponding locations in register 36 by write-in circuit 38. Thereafter, during a read-out cycle, (as determined by the read/write control circuit 42) the read-out circuit 44 reads out the synchronized and stored control signals from the register 36. These signals then augment the normal operation of the AM circuit 14, by adding "increased brightness" signals at the appropriate locations in the video signal sent to the AM circuit from terminal 18. Accordingly, the CRT 10 receives signals from the AM circuit 14 which cause the intensity of the image displayed thereupon to be increased at the desired points corresponding to the selected pattern or patterns.

Figure 3:
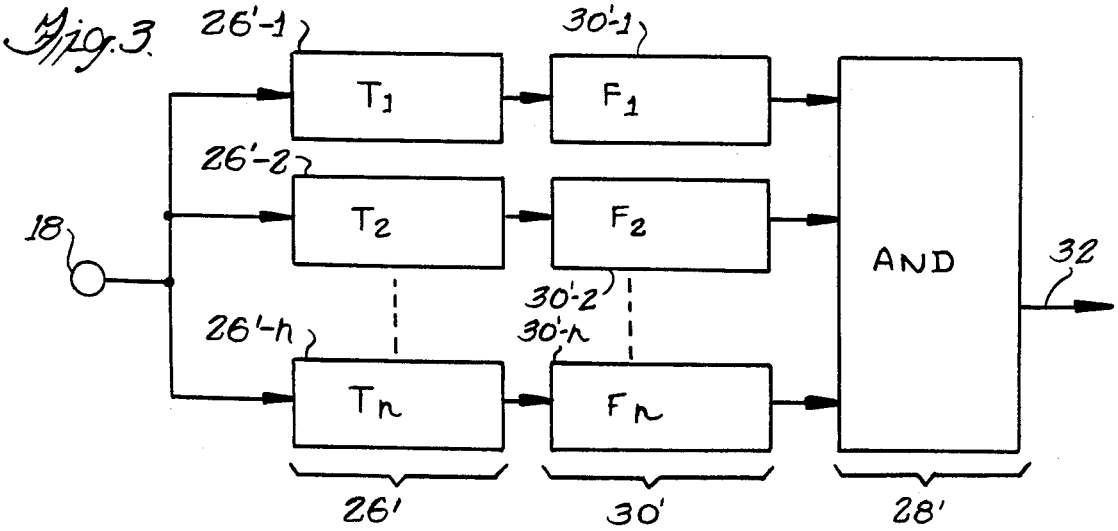
FIG. 3 is a block schematic diagram illustrating further details of a second embodiment of apparatus in accordance with the invention.

Referring now to FIG. 3, a further embodiment of a portion of the circuit of FIG. 2 is illustrated. In FIG. 3, the duration detection circuits 26, 28 takes the form of a plurality of time delay circuits 26' (26'-1, 26'-2 . . . 26'-n) and an AND circuit 28'. The pattern detection circuit 30 takes the form of a plurality of filter circuits 30-1, 30-2 . . . 30-n, located intermediate respective circuits 26'-1, etc. and the AND circuit 28'.

In operation, the respective time delays (T1, T2, etc.), of the time delay circuits 26' are selected such that the difference between successive time delays is substantially an integral multiple of the horizontal scan time of the system. This scan time is determined by the horizontal synch signal at output 22. The respective outputs of the time delay circuits are fed to respective ones of the filter circuits.

In the illustrated embodiment, the filters (F1, F2, etc.), are matched to the frequency characteristics of the pattern or patterns to be detected. Hence, it is possible to detect the existence of a desired alphanumeric character or any other pattern or image in the video signal 16 by the selection of the filtering characteristics of the filters to be utilized in the circuit of FIG. 4. Accordingly, desired patterns of at least a desired number of horizontal scan frames duration are detected by delaying and filtering the video signal in this fashion.

The respective outputs of the filters are fed to respective inputs of the AND circuit 28'. Accordingly, if the desired pattern or patterns are detected by the filters at all of the time delay circuits 26', the AND gate 28' will produce the control output signal at the output 32. That is, each time all of the output pulses are simultaneously produced by all of the filters, the AND circuit 28' will generate the control output signal.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. In a method for intensifying brightness of a predetermined pattern in a video display the improvement comprising the steps of: detecting the duration of predetermined portions of said video signal, including the step of simultaneously delaying said video signal by each of a predetermined plural number of predetermined time delay factors; detecting said predetermined pattern in said predetermined portions of said video signal including frequency filtering said time delayed signals; and producing an output control signal in response to each detection of said predetermined pattern of at least a predetermined duration.

2. The improvement according to claim 1 wherein the step of frequency filtering further includes separately frequency filtering each of said delayed video signals with one of a corresponding plurality of predetermined filter characteristics.

3. The improvement according to claim 2 wherein the step of duration detecting further comprises detecting the simultaneous presence of a predetermined plural number of said separately filtered signals.

4. The improvement according to claim 1 and further including the steps of receiving a synchronizing signal; assigning predetermined positions in a register in accordance with said synchronizing signal; and writing into said register information corresponding to the desired brightness distribution of an image to be displayed upon said video display in response to said output control signal and said synchronizing signal.

5. In an apparatus for intensifying brightness of a predetermined pattern in a video display, the improvement comprising: duration detecting means comprising a plurality of time delay circuit means arranged in parallel circuit for delaying said video signal by each of a predetermined plurality of predetermined time delay factors to thereby produce a corresponding plurality of time delayed video signals; pattern detecting means comprising filtering circuit means responsive to a predetermined video signal frequency distribution for detecting a predetermined pattern of said time delayed signals corresponding to said predetermined portions of said video signal and for producing a corresponding pattern detection signal; and control means for producing an output control signal in response to presence of said pattern detection signal.

6. The improvement in accordance with claim 5 wherein said filtering circuit means comprises a plurality of filter circuits, each coupled to filter one of said plurality of time delayed video signals and each responsive to a predetermined frequency distribution of the time delayed video signal for producing one said pattern detection signal.

7. The improvement in accordance with claim 6 wherein said duration detecting means further comprises AND circuit means responsive to the presence of said pattern detection signals from a predetermined plural number of said filter circuits for producing said output control signal.

8. The improvement in accordance with claim 5 and further including register means for storing information corresponding to the desired brightness level at a plurality of locations on said video display; counting circuit means responsive to a synchronizing signal for indicating locations in said register; and register writing means responsive to said counting means and to said control output signal for writing into said register information which corresponds to a desired brightness level at each of said locations on said video display.

9. In a method for intensifying brightness of a predetermined pattern in a video display, the improvement comprising the steps of: detecting the duration of predetermined portions of said video signal and producing a corresponding duration signal; comparing the level of said duration signal with a predetermined threshold level and producing an output pulse for each signal which is in excess of said predetermined threshold level; detecting said predetermined pattern in said predetermined portions of said video signal; and producing an output control signal in response to each detection of said predetermined pattern of at least a predetermined duration and in excess of said predetermined threshold level.

10. In apparatus for intensifying brightness of a predetermined pattern in a video display, the improvement comprising: duration detecting means for detecting the duration of predetermined portions of said video signal and producing a corresponding duration signal; threshold detection means for comparing the level of the duration signal with a predetermined threshold level and producing an output pulse for each signal which is in excess of said predetermined threshold level; pattern detecting means for detecting a predetermined pattern of said output pulses corresponding to predetermined portions of said video signal and for producing a corresponding pattern detection signal; and control means for producing an output control signal in response to presence of said pattern detection signal.

* * * * *